US009920467B2

(12) United States Patent
Ajiki et al.

(10) Patent No.: US 9,920,467 B2
(45) Date of Patent: Mar. 20, 2018

(54) WASHING MACHINE WITH A DETERGENT SUPPLY UNIT HAVING A LEAKAGE PREVENTION PASSAGE

(71) Applicant: SAMSUNG ELECTRONICS CO., LTD., Suwon-si, Gyeonggi-do (KR)

(72) Inventors: Tomohito Ajiki, Osakabu (JP); Gyu Dong Jeon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 434 days.

(21) Appl. No.: 14/543,163

(22) Filed: Nov. 17, 2014

(65) Prior Publication Data

US 2015/0135780 A1 May 21, 2015

(30) Foreign Application Priority Data

Nov. 18, 2013 (KR) ..... 10-2013-0139957

(51) Int. Cl.
*D06F 39/02* (2006.01)
*D06F 39/08* (2006.01)

(52) U.S. Cl.
CPC ..... *D06F 39/022* (2013.01); *D06F 39/081* (2013.01); *D06F 39/088* (2013.01)

(58) Field of Classification Search
None
See application file for complete search history.

(56) References Cited

U.S. PATENT DOCUMENTS 6,474,351 B1 11/2002 Cerruti et al.
2009/0322195 A1* 12/2009 Joerger ..... D06F 39/02 312/334.1
2015/0135780 A1* 5/2015 Ajiki ..... D06F 39/002 68/17 R

FOREIGN PATENT DOCUMENTS

CN 200971435 Y 11/2007
CN 201087290 Y 7/2008
CN 101413204 A 4/2009
CN 201801756 U 4/2011

OTHER PUBLICATIONS

Chinese Office Action dated Oct. 31, 2017 in corresponding Chinese Patent Application No. 201410657823.1.

* cited by examiner

*Primary Examiner* — Michael E Barr
*Assistant Examiner* — Rita P Adhlakha
(74) *Attorney, Agent, or Firm* — Staas & Halsey LLP

(57) ABSTRACT

A washing machine includes a cabinet, a fixed tub disposed in the cabinet to store washing water, a rotating tub rotatably disposed in the fixed tub, and a detergent supply unit configured to supply detergent into the rotating tub. The detergent supply unit includes a main body configured to form an exterior, a detergent storage portion provided in the main body, and a leakage prevention passage provided to enclose at least part of the detergent storage portion and configured to guide the washing water overflowing from the detergent storage portion into the cabinet. By such configuration, it is possible to prevent the leakage of washing water and enhance washing water feed efficiency.

16 Claims, 11 Drawing Sheets

WASHING MACHINE WITH A DETERGENT SUPPLY UNIT HAVING A LEAKAGE PREVENTION PASSAGE

CROSS-REFERENCE TO RELATED APPLICATIONS

This application claims the benefit of Korean Patent Application No. 10-2013-0139957, filed on Nov. 18, 2013 in the Korean Intellectual Property Office, the disclosure of which is incorporated herein by reference.

BACKGROUND

1. Field

One or more embodiments relate to a washing machine, and more particularly to a washing machine in which a structure of a detergent supply unit is improved.

2. Description of the Related Art

In general, washing machines are apparatuses for washing laundry using water and detergent, and include a cabinet, a fixed tub configured to store washing water, and a rotating tub rotatably disposed in the fixed tub.

The detergent supply is achieved in a detergent supply unit. In general, washing water in which detergent in the detergent supply unit and water supplied by a water feed unit are mixed is supplied into the rotating tub, and a washing process is performed.

In the detergent supply unit, the detergent and the water are mixed, and the mixed washing water is supplied into the rotating tub. However, in the case in which the washing water leaks in the detergent supply unit, the internal elements of the washing machine may be corroded, contaminated, or the like.

SUMMARY

The foregoing described problems may be overcome and/or other aspects may be achieved by one or more embodiments of a washing machine which may prevent leakage of water from a detergent supply unit.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

In accordance with one or more embodiments, a washing machine may include a cabinet, a fixed tub disposed in the cabinet to store washing water, a rotating tub rotatably disposed in the fixed tub, and a detergent supply unit configured to supply detergent into the rotating tub, wherein the detergent supply unit may include a main body configured to form an exterior, a detergent storage portion provided in the main body, and a leakage prevention passage provided to enclose at least part of the detergent storage portion and configured to guide the washing water overflowing from the detergent storage portion into the cabinet.

The detergent supply unit may further include a leaking water outlet port provided at the leakage prevention passage so that the washing water guided through the leakage prevention passage is discharged into the rotating tub.

A first portion of the leakage prevention passage may be formed to be higher than a second portion thereof disposed to be closer to the leaking water outlet port than the first portion.

The leakage prevention passage may be formed at an entire area along a circumference of the main body.

The detergent supply unit may include an inner wall by which the detergent storage portion and the leakage prevention passage are partitioned from each other and which is provided to enclose the detergent storage portion, and an outer wall provided to enclose the inner wall and configured to form the leakage prevention passage between the inner wall and the outer wall.

The detergent supply unit may include a lower case configured to have the inner wall and the outer wall, and an upper case configured to have a leakage prevention rib formed in a labyrinth structure with respect to the inner wall and the outer wall to prevent leakage of the washing water from the main body and coupled to an upper portion of the lower case to form the detergent storage portion.

The detergent supply unit may further include a detergent introduction case provided above the upper case and configured to have an inlet flange to pour the detergent into the detergent storage portion.

The leakage prevention rib may include a first leakage prevention rib inserted between the inner wall and the outer wall, and a second leakage prevention rib formed along an inner side of the inner wall.

The detergent supply unit may include a water feed port in communication with the detergent storage portion to receive water from an outside, and a washing water feed pipe configured so that the washing water in which the water supplied to the detergent storage portion and the detergent are mixed is supplied into the cabinet.

The washing water feed pipe may be formed so that the washing water is supplied into the cabinet by a siphon phenomenon.

The detergent supply unit may further include a washing water guide rib provided above the detergent storage portion to guide the washing water from the water feed port to the washing water feed pipe.

The washing water guide rib may be formed in a direction which blocks a flow direction of the washing water from the water feed port.

The washing water guide rib may be provided at the lower case.

In accordance with one or more embodiments, a washing machine may include a cabinet, a fixed tub disposed in the cabinet to store washing water, a rotating tub rotatably disposed in the fixed tub, and a detergent supply unit configured to supply detergent into the cabinet, wherein the detergent supply unit may include a detergent storage portion, a lower case having a first wall configured to form a circumference of the detergent storage portion and a second wall formed to be spaced apart from the first wall and to enclose the first wall, and an upper case configured to have a leakage prevention rib formed to be overlapped with the first wall and the second wall and thus to possibly prevent the washing water from leaking to an outside of the detergent supply unit, and disposed on the lower case.

Assuming that a radial direction from the detergent storage portion is a first direction, the first wall, the second wall, and the leakage prevention rib may be overlapped with each other to block the first direction.

The leakage prevention rib may include a first leakage prevention rib inserted between the first wall and the second wall.

The leakage prevention rib may further include a second leakage prevention rib formed along an inner side of the first wall.

The first wall, the second wall, and the leakage prevention rib may be formed at an entire area along a circumference of the detergent storage portion.

The detergent supply unit may further include a leakage prevention passage provided between the first wall and the second wall to guide the washing water overflowing from the detergent storage portion into the rotating tub.

The detergent supply unit may further include a leaking water outlet port provided at the leakage prevention passage so that the washing water guided through the leakage prevention passage is discharged into the rotating tub.

The leakage prevention passage may be formed to be inclined toward the leaking water outlet port.

The leakage prevention passage may be formed at an entire area along a circumference of the main body.

In accordance with one or more embodiments, a washing machine may include a cabinet, a fixed tub disposed in the cabinet to store washing water, a rotating tub rotatably disposed in the fixed tub, and a detergent supply unit configured to supply detergent into the cabinet, wherein the detergent supply unit may include a main body configured to have a lower case forming the detergent storage portion and an upper case disposed on the lower case, a first waterproofing structure having a plurality of lower side walls and at least one upper side wall which are respectively formed to extend from the lower case and the upper case, to be overlapped with each other, and thus to possibly prevent leakage of the washing water from the detergent storage portion, and a second waterproofing structure having a leakage prevention passage defined by one pair of lower side walls of the plurality of the lower side walls to possibly prevent leakage of the washing water from the detergent storage portion.

The plurality of lower side walls may include an inner wall provided to enclose the detergent storage portion and an outer wall formed to be spaced apart from the inner wall and configured to form the leakage prevention passage between the inner wall and the outer wall.

The at least one upper side wall may include a first leakage prevention rib inserted between the inner wall and the outer wall, and a second leakage prevention rib formed along an inner side of the inner wall.

The second waterproofing structure may further include a leaking water outlet port provided at the leakage prevention passage so that the washing water guided through the leakage prevention passage may be discharged into the rotating tub.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
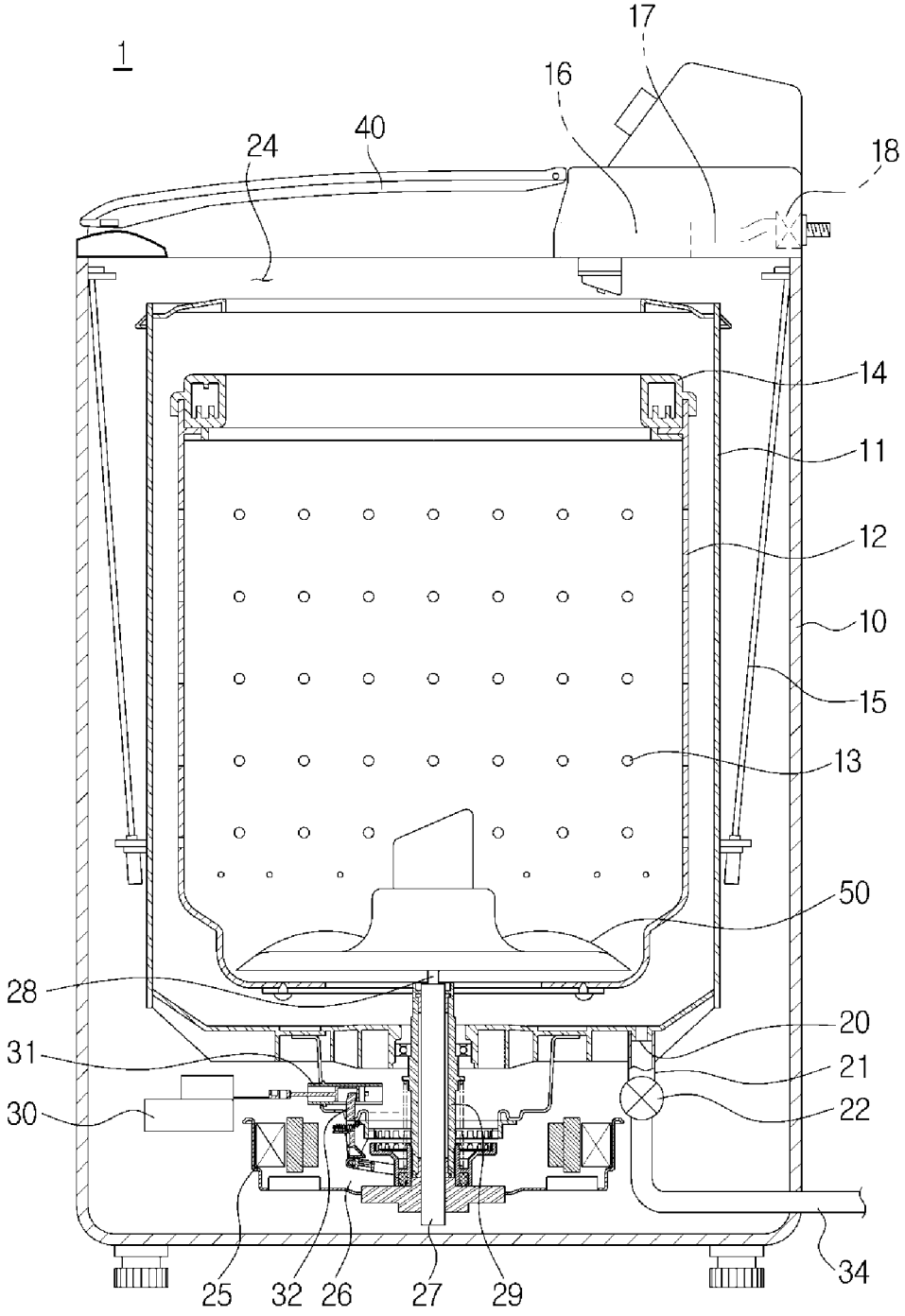
FIG. 1 is a cross-sectional view of a washing machine in accordance with one or more embodiment.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

Hereinafter, the embodiments of the present invention are described in detail with reference to the accompanying drawings.

Figure 2:
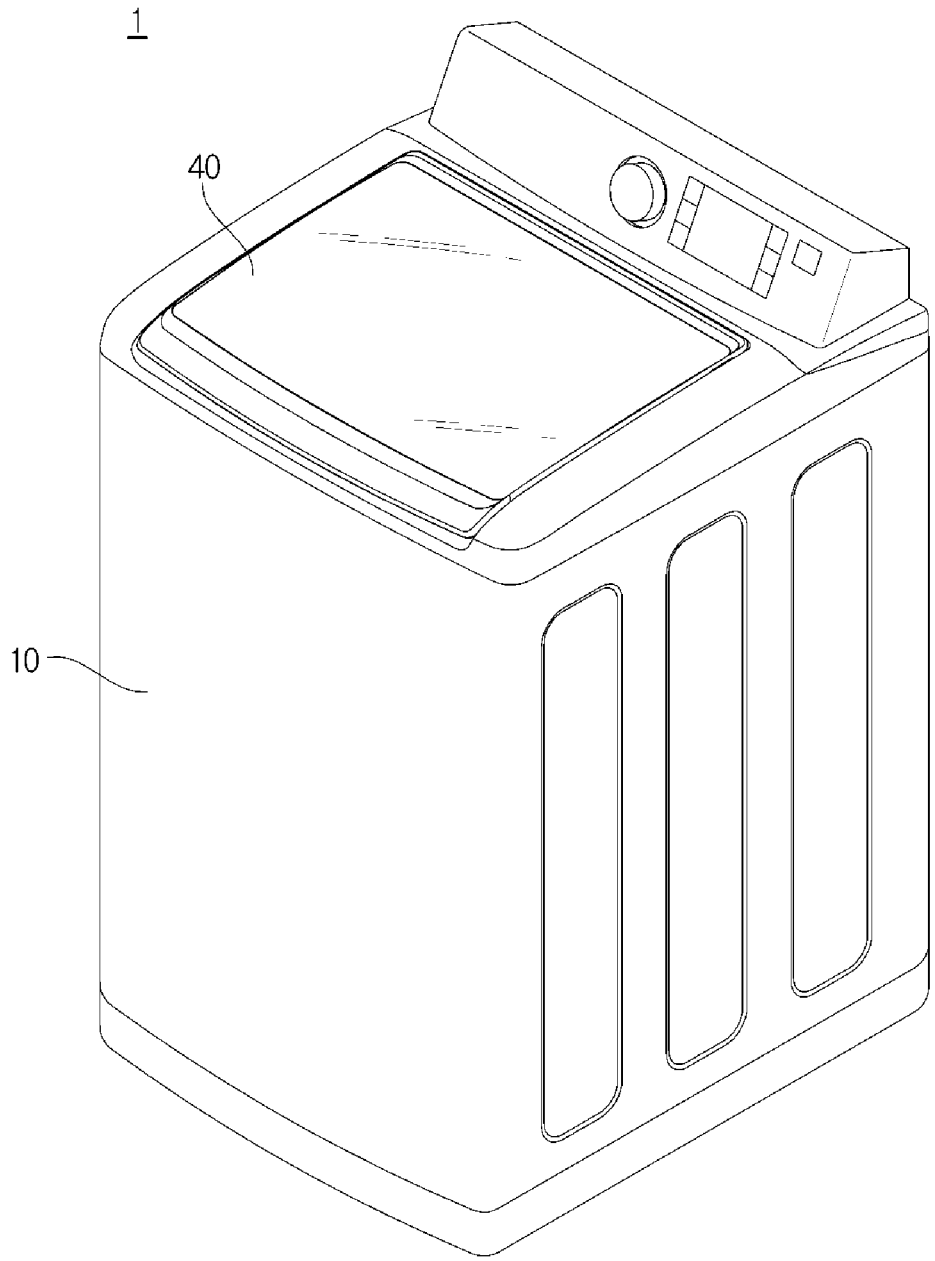
FIG. 2 is a perspective view of a washing machine in accordance with one or more embodiment.
Figure 3:
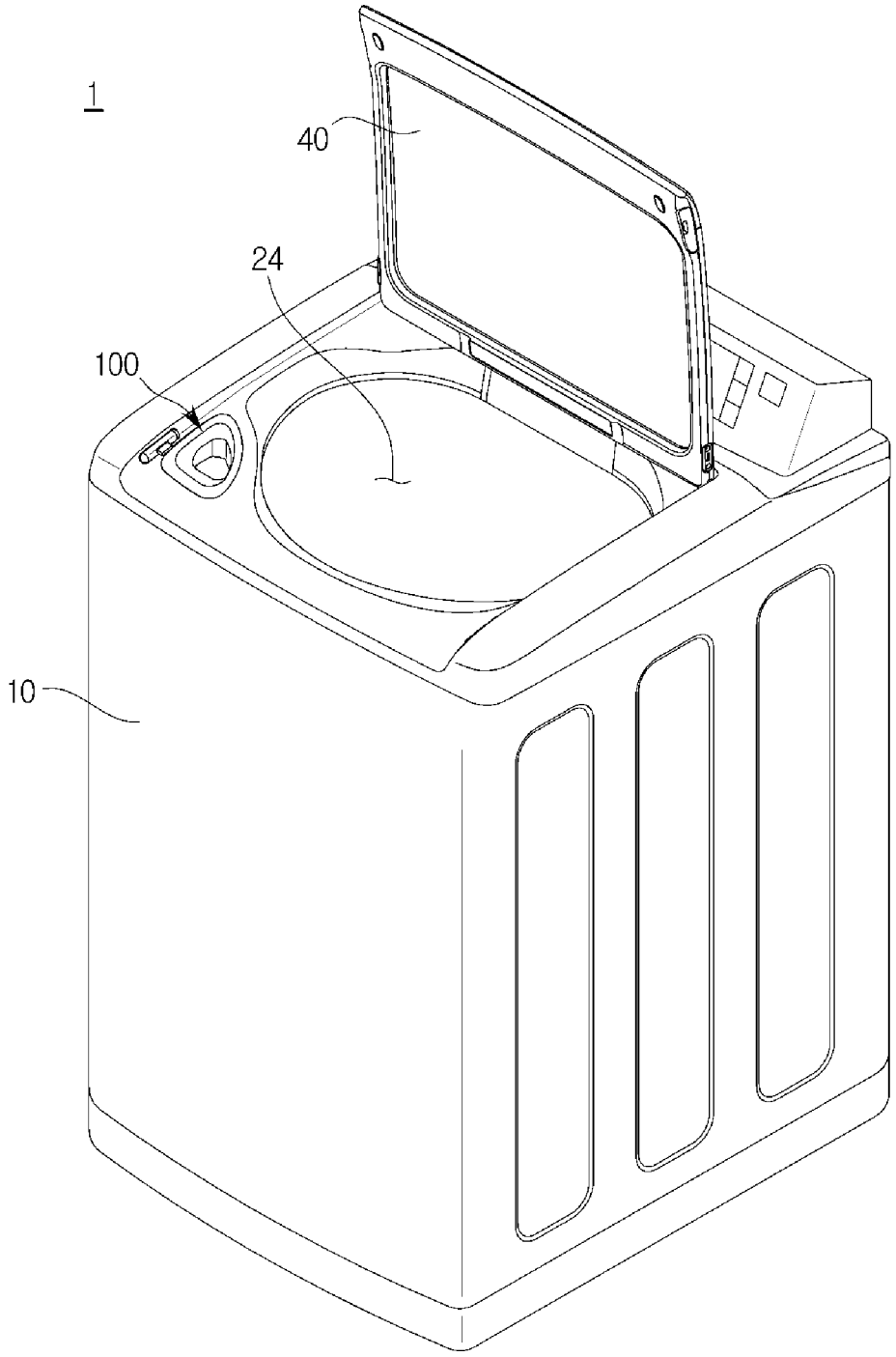
FIG. 3 is a perspective view illustrating a state in which a door of a washing machine is opened in accordance with one or more embodiment.

FIG. 1 is a cross-sectional view of a washing machine in accordance with one or more embodiment, FIG. 2 is a perspective view of a washing machine in accordance with one or more embodiment, and FIG. 3 is a perspective view illustrating a state in which a door of a washing machine is opened in accordance with one or more embodiment.

As illustrated in FIG. 1, a washing machine 1 may include a cabinet 10 configured to form an exterior, a fixed tub 11 disposed in the cabinet 10 to store washing water, a rotating tub 12 rotatably disposed in the fixed tub 11, and a pulsator 50 disposed in the rotating tub 12 to generate a water current.

An opening 24 may be formed at an upper portion of the cabinet 10 so that laundry may be put into the rotating tub 12. The opening 24 may be closed or opened by a door 40 installed on the cabinet 10. The fixed tub 11 may be supported to the cabinet 10 through a suspension unit 15.

A water pipe 17 configured to supply the washing water to the fixed tub 11 may be installed above the fixed tub 11. One side of the water pipe 17 may be connected to an external water supply source, and the other side thereof may be connected to a detergent supply unit 16. The water supplied through the water pipe 17 may pass through the detergent supply unit 16 and may be supplied into the fixed tub 11 together with detergent. A water feed valve 18 may be installed at the water pipe 17 to control the water supply.

The rotating tub 12 may have a cylindrical shape of which an upper portion may be opened, and a plurality of drainage holes 13 may be formed in a side surface thereof. A balancer 14 may be installed at an upper portion of the rotating tub 12 so that the rotating tub 12 may be stably rotated when the rotating tub 12 is rotated at a high speed.

A motor 25 configured to generate a driving force rotating the rotating tub 12 and the pulsator 50, and a power switch unit 26 configured to simultaneously or selectively transmit the driving force generated from the motor 25 to the rotating tub 12 and the pulsator 50 may be installed at a lower outer side of the fixed tub 11.

A hollow drainage shaft 29 may be coupled to the rotating tub 12, and a washing shaft 27 installed in a hollow portion of the drainage shaft 29 may be coupled to the pulsator 50 through a washing shaft coupling part 28. The motor 25 may simultaneously or selectively transmit the driving force to the rotating tub 12 and the pulsator 50 according to an up and down movement of the power switch unit 26.

The power switch unit 26 may include an actuator 30 configured to generate a driving force for power switching, a rod part 31 configured to perform a rectilinear motion according to an operation of the actuator 30, and a clutch part 32 connected with the rod part 31 to be rotated according to an operation of the rod part 31.

A drain hole 20 may be provided at a bottom of the fixed tub 11 to discharge the washing water stored in the fixed tub 11, and a first drainpipe 21 may be connected to the drain hole 20. A drain valve 22 configured to control drainage may be installed at the first drainpipe 21. An outlet port of the drain valve 22 may be connected to a second drainpipe 34 configured to discharge the washing water to an outside.

Figure 4:
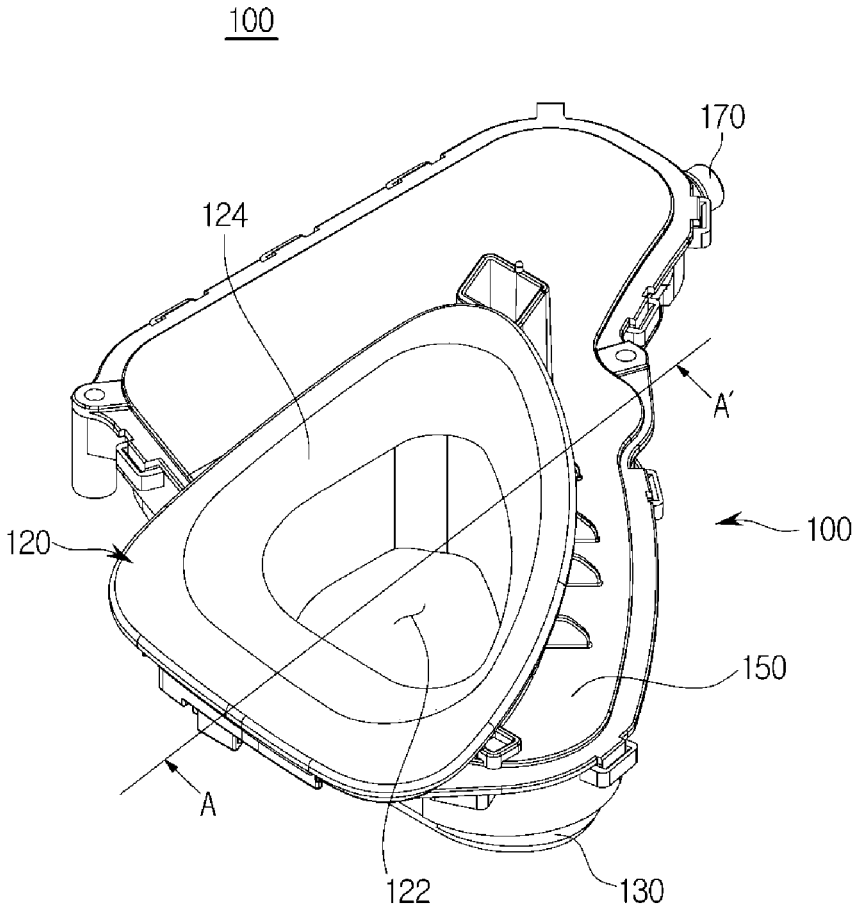
FIG. 4 is a perspective view of a detergent supply unit in accordance with one or more embodiment.
Figure 5:
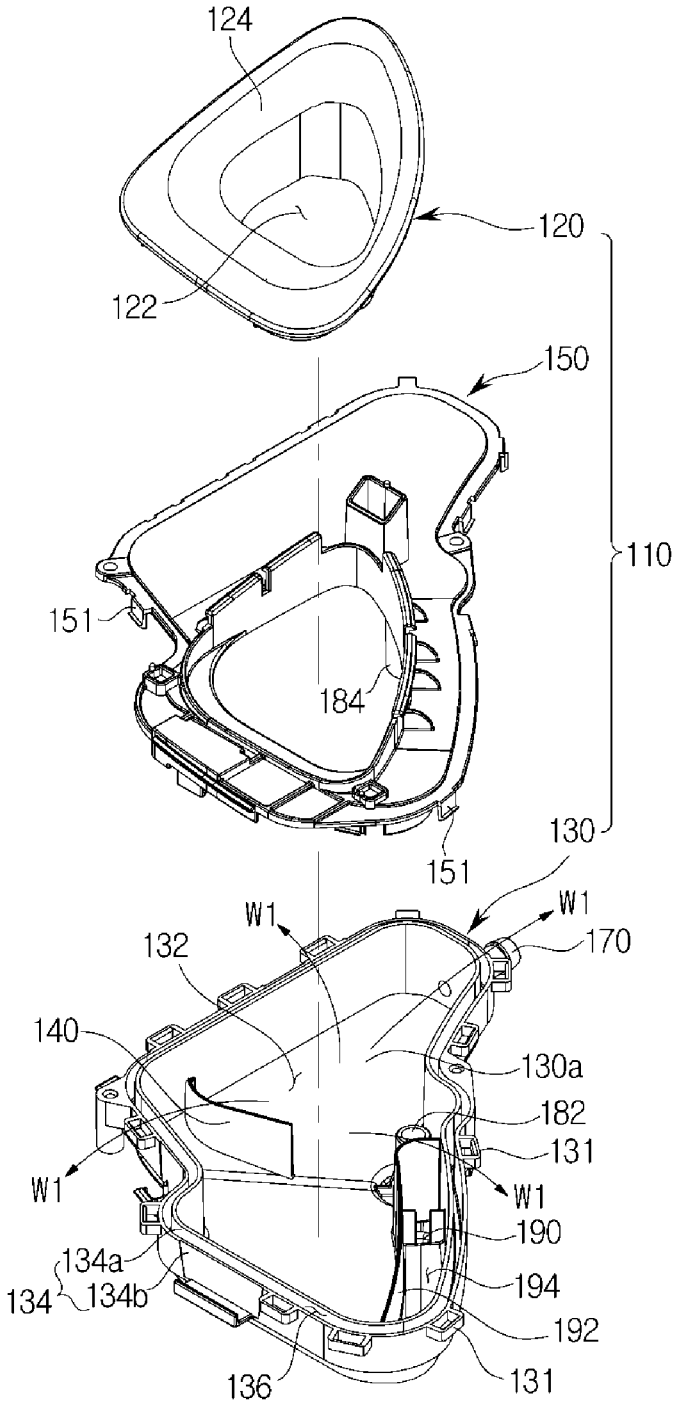
FIG. 5 is an exploded perspective view of a detergent supply unit in accordance with one or more embodiment.
Figure 6:
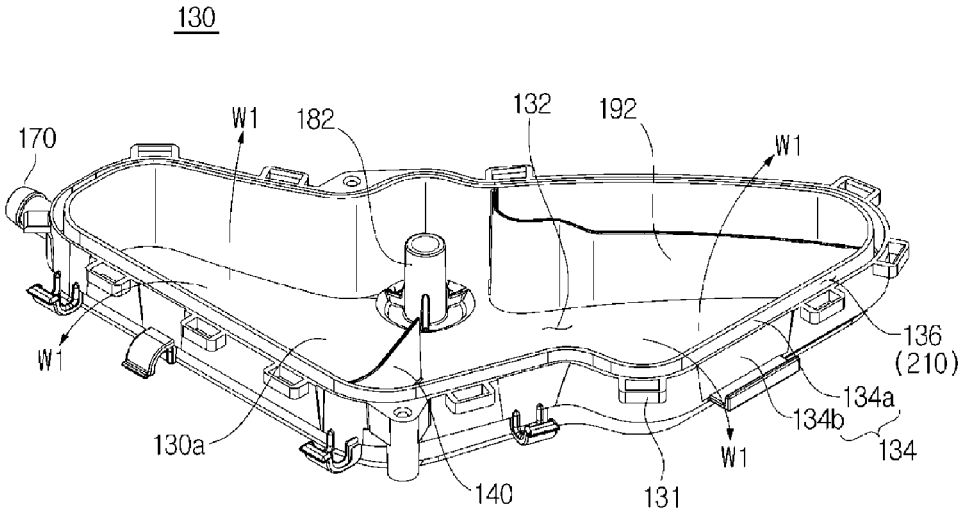
FIG. 6 is a perspective view of a lower case in accordance with one or more embodiment.
Figure 7:
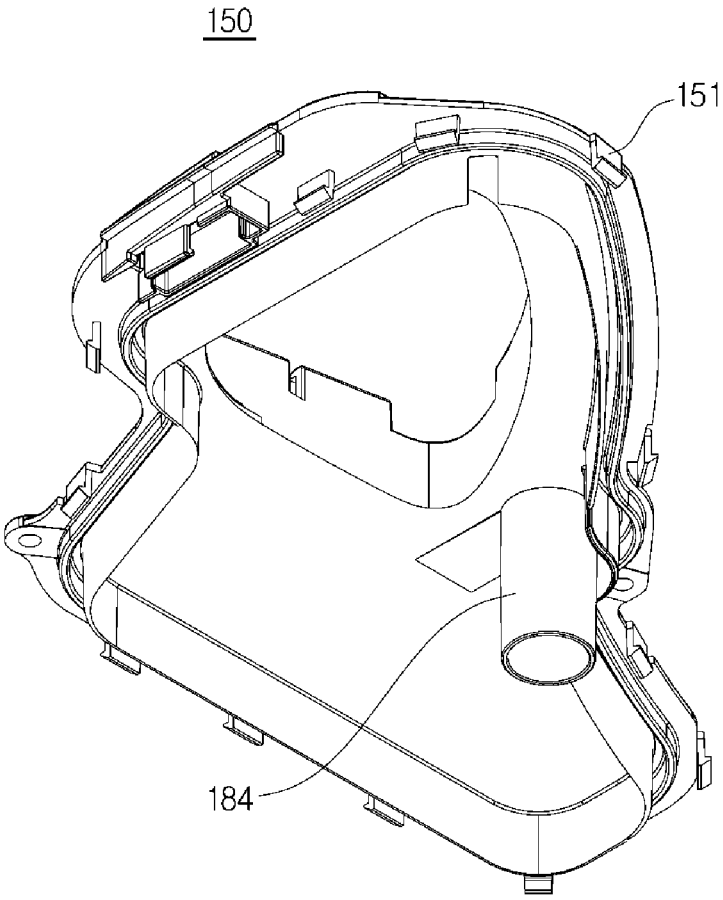
FIG. 7 is a lower perspective view of an upper case in accordance with one or more embodiment.
Figure 8:
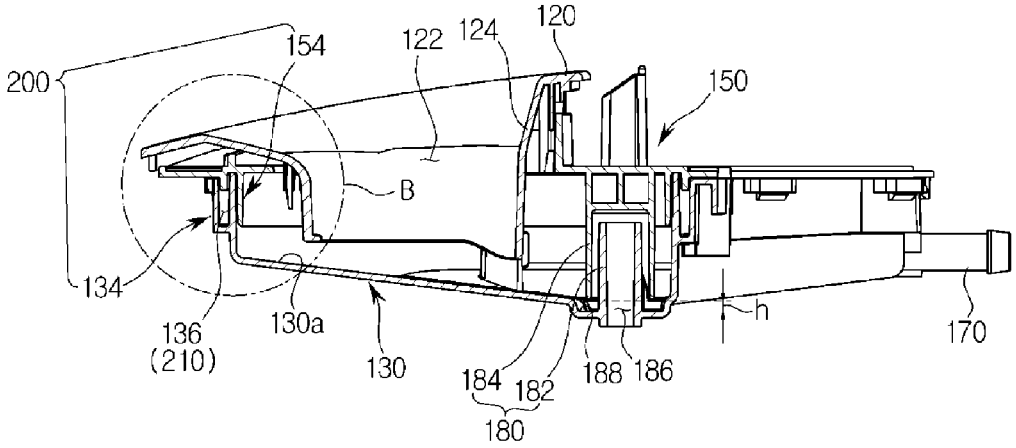
FIG. 8 is a cross-sectional view of a washing machine in accordance with one or more embodiment, such as the washing machine of FIG. 4, taken along line A-A' of FIG. 4.
Figure 10:
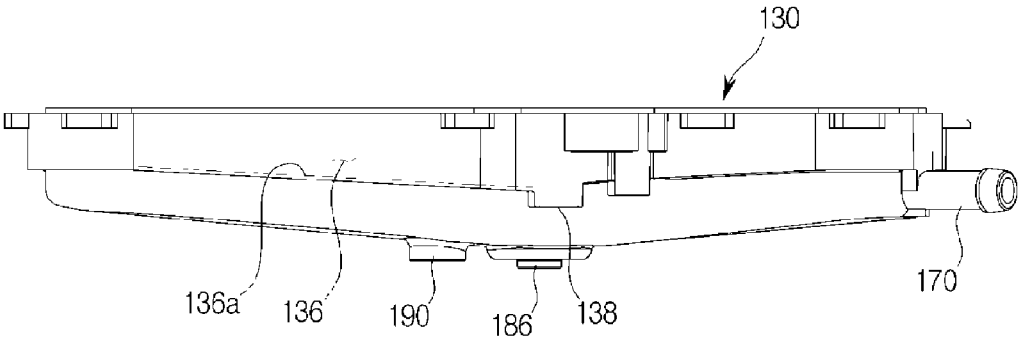
FIG. 10 is a side view of the lower case of a washing machine in accordance with one or more embodiment.

FIG. 4 is a perspective view of a detergent supply unit in accordance with one or more embodiment, FIG. 5 is an exploded perspective view of a detergent supply unit in accordance with one or more embodiment, FIG. 6 is a perspective view of a lower case in accordance with one or more embodiment, FIG. 7 is a lower perspective view of an upper case in accordance with one or more embodiment, FIG. 8 is a cross-sectional view of a washing machine in accordance with one or more embodiment, such as the washing machine of FIG. 4, taken along line A-A' of FIG. 4, and FIG. 10 is a side view of a lower case of the washing machine in accordance with one or more embodiment.

The detergent supply unit 100 may be configured to store the detergent, receive water and supply the washing water mixed with the detergent for a washing process. The washing water in which the detergent and the water are mixed may be introduced into the cabinet, specifically, the rotating tub 12.

The detergent supply unit 100 may include a main body 110 configured to form an exterior, a water feed port 170 through which the water may be supplied, and a washing water feed pipe 180 through which the water mixed with the detergent may be discharged.

The main body 110 may include a detergent introduction case 120, an upper case 150, and a lower case 130. A detergent storage portion 132 in which the detergent is stored may be provided in the main body 110. The kind of detergent is not limited, and various detergents such as liquid detergent, bleach, and fabric softener may be used.

Hereinafter, the main body 110 will be described in detail.

The water feed port 170 may be a passage connected with the water feed valve 18 and the water pipe 17 and may be configured to transfer the water supplied from the outside to the detergent supply unit 100. The arrangement of the water feed port 170 is not limited. In the embodiment, the water feed port 170 may be disposed at a side surface of the detergent supply unit 100 to supply the water to the detergent storage portion 132.

The washing water feed pipe 180 may be provided so that the washing water in which the detergent and the water are mixed in the detergent supply unit 100 may be discharged into the rotating tub 12. A shape of the washing water feed pipe 180 is not limited. However, in the embodiment, the washing water feed pipe 180 may be formed in a siphon structure so that the washing water may be discharged by a siphon phenomenon when reaching a predetermined level or more in the detergent supply unit 100. The washing water feed pipe 180 may be disposed above the detergent storage portion 132, such that the water may be introduced into the detergent storage portion 132 containing detergent through the water feed port 170 to form the washing water and the washing water may be discharged into the rotating tub 12 through the washing water feed pipe 180 when reaching the predetermined level.

A subsidiary washing water feed port 190 may be provided above the detergent storage portion 132 so that the washing water may be discharged into the rotating tub 12. Specifically, in the case in which an amount of the water introduced into the main body 110 is greater than an amount of the washing water discharged from the detergent storage portion 132 through the washing water feed pipe 180, the subsidiary washing water feed port 190 may be provided to prevent the washing water from overflowing in the detergent storage portion 132. The subsidiary washing water feed port 190 may be provided above a subsidiary washing water feed passage 194 defined by a subsidiary guide rib 192. if the washing water in the detergent storage portion 132 reaches the predetermined level or more and overflows into the subsidiary washing water feed passage 194 that may be disposed inside the subsidiary guide rib 192, the overflowing washing water may flow along the subsidiary washing water feed passage 194 and may be discharged into the rotating tub 12 through the subsidiary washing water feed port 190.

A lower siphon duct 182 that may have a washing water feed port 186 formed therein may be provided in the lower case 130, and an upper siphon duct 184 that may have a greater diameter than that of the lower siphon duct 182 may be provided at the upper case 150. The lower siphon duct 182 may be formed to extend from the lower case 130 and the upper siphon duct 184 may be formed to extend from the upper case 150. The upper siphon duct 184 may be provided to cover the lower siphon duct 182, and an end of the upper siphon duct 184 may be provided to be spaced apart from a bottom surface 130*a* of the lower case 130 by a predetermined distance. The washing water stored in the detergent storage portion 132 may be discharged to the washing water feed port 186 through fluid passages of the upper siphon duct 184 and the lower siphon duct 182 until the level of the washing water is the same as a difference h between the bottom surface 130*a* of the lower case 130 and the end of the upper siphon duct 184. To minimize the remaining of the washing water in the detergent supply unit 100, the bottom surface 130*a* of the lower case 130 may further include a groove 188 formed around the lower siphon duct 182 to be more concave than the adjacent bottom surface 130*a* of the lower case 130. As the groove 188 is provided, the residual amount of the washing water corresponding to the difference h between the bottom surface 130*a* of the lower case 130 and the end of the upper siphon duct 184 may be minimized.

As described above, the main body 110 may include the detergent introduction case 120, the upper case 150, and the lower case 130.

The detergent introduction case 120 may be disposed to be exposed to an outside, such that the detergent may be introduced into the detergent storage portion 132. The detergent introduction case 120 may include a detergent inlet port 122 provided above the upper case 150 to pour the detergent into the detergent storage portion 132. Further, the detergent introduction case 120 may further include an inlet flange 124 configured to be inclined toward the detergent inlet port 122 and thus to facilitate introduction of the detergent through the detergent inlet port 122.

The lower case 130 may include the detergent storage portion 132 and a lower side wall 134 configured to enclose the detergent storage portion 132.

The detergent storage portion 132 may be defined by the bottom surface 130*a* of the lower case 130 and the lower side wall 134. The detergent storage portion 132 may be provided to store the water or the detergent and the washing water in which the water and the detergent are mixed. Further, the washing water feed pipe 180 may be disposed to be in communication with the water feed port 170, such that the water may be introduced therethrough and the washing water is discharged into the rotating tub 12.

The lower side wall 134 may be formed to extend upward from the bottom surface 130*a* of the lower case 130. A plurality of lower side walls 134 may be provided. In one or more embodiment, the lower side wall 134 may include an inner wall 134*a* provided around the detergent storage portion 132 and an outer wall 134*b* formed to be spaced apart from the inner wall 134*a* and also to enclose the inner wall 134*a*.

Sections of the inner wall 134*a* and the outer wall 134*b* are not limited. In one or more embodiment, the inner wall 134*a* and the outer wall 134*b* may be formed to enclose the entire area of the detergent storage portion 132. As the plurality of side walls are provided, the leakage of the washing water stored in the detergent storage portion 132 may be doubly prevented. Since the number of lower side walls 134 is not limited, the inner wall 134*a* and the outer wall 134*b* may be referred to as a first wall and a second wall, respectively.

The detergent supply unit 100 may further include a leakage prevention passage 136.

The leakage prevention passage 136 may be provided to guide the washing water overflowing from the detergent storage portion 132. The leakage prevention passage 136 may be provided between the inner wall 134*a* and the outer wall 134*b*.

The leakage prevention passage 136 may be partitioned from the detergent storage portion 132 by the inner wall 134*a*. Further, a width of the leakage prevention passage 136 may be defined by a spaced gap between the inner wall 134*a* and the outer wall 134*b*. The width of the leakage prevention passage 136 may be not constant.

The leakage prevention passage 136 may be provided to enclose at least part of the detergent storage portion 132. In one or more embodiment, the leakage prevention passage 136 may be provided to enclose the entire area of the detergent storage portion 132. Due to such configuration, the washing water leaking from the entire area of the detergent storage portion 132 in a circumferential direction thereof may be guided through the leakage prevention passage 136.

The detergent supply unit 100 may further include a leaking water outlet port 138 through which the washing water guided through the leakage prevention passage 136 may be supplied into the rotating tub 12. The leaking water outlet port 138 may be provided at the leakage prevention passage 136.

The leakage prevention passage 136 may be formed to be inclined toward the leaking water outlet port 138, such that the washing water overflowing from the detergent storage portion 132 may smoothly flow toward the leaking water outlet port 138. That is, a fluid passage bottom surface 136*b* which is a bottom surface of the leakage prevention passage 136 may be provided to be inclined toward the leaking water outlet port 138.

In other words, a first portion of the bottom surface of the leakage prevention passage 136 may be formed to be higher than a second portion thereof disposed to be closer to the leaking water outlet port 138 of the leakage prevention passage 136 than the first portion.

The upper case 150 may be disposed on the lower case 130.

Specifically, coupling protrusions 151 may be formed along a circumference of the upper case 150, and coupling grooves 131 corresponding to the coupling protrusions 151 may be formed along a circumference of the lower case 130, and thus the upper case 150 and the lower case 130 may be coupled by the coupling of the coupling protrusions 151 and the coupling grooves 131. Shapes and arrangements of the coupling protrusions 151 and the coupling grooves 131 are not limited.

The upper case 150 may include an upper side wall 154 corresponding to the lower side wall 134.

The upper side wall 154 may be a side wall formed to extend downward from the upper case 150. At least one upper side wall 154 may be provided. In one or more embodiment, the upper side wall 154 may be formed to be overlapped with the inner wall 134*a* and the outer wall 134*b*. The upper side wall 154 may be referred to as a leakage prevention rib 154.

Figure 9:
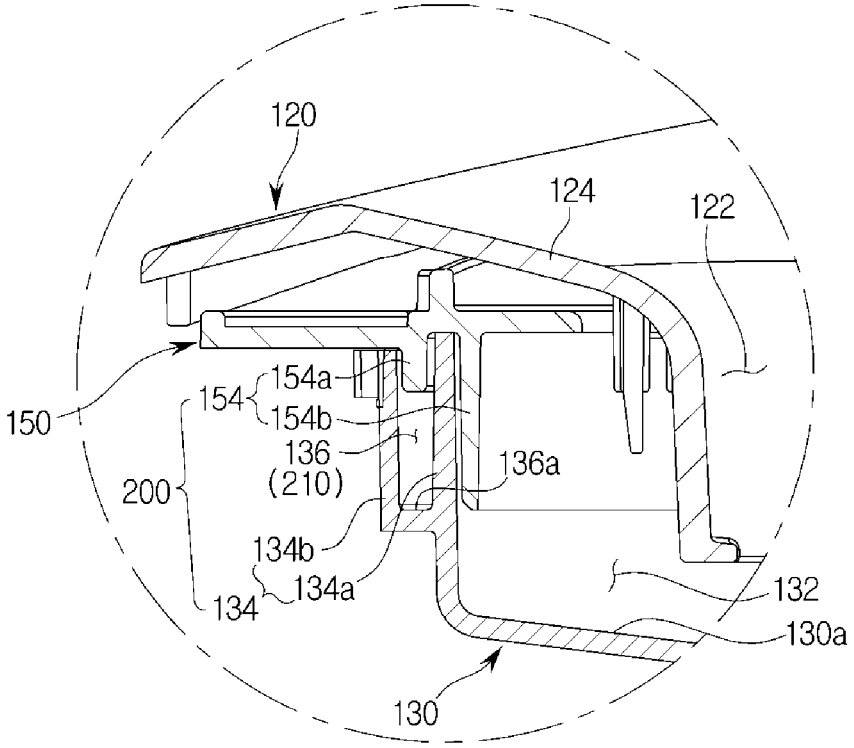
FIG. 9 is an enlarged view of a washing machine in accordance with one or more embodiment, such as the washing machine of FIG. 8, illustrating a portion B of FIG. 8.

FIG. 9 is an enlarged view of a washing machine in accordance with one or more embodiment, such as the washing machine of FIG. 8, illustrating a portion B of FIG. 8.

The leakage prevention rib 154 may be formed as a labyrinth structure formed to be overlapped with the inner wall 134*a* and the outer wall 134*b*. Specifically, the lower side wall 134 may be formed to extend upward from the lower case 130, and the leakage prevention rib 154 may be formed to extend downward from the upper case 150, such that the lower side wall 134 and the leakage prevention rib 154 may be overlapped with each other, thereby forming the labyrinth structure.

Since the leakage prevention rib 154 may be disposed to be overlapped with the inner wall 134*a* and the outer wall 134*b*, the washing water may be prevented from leaking through a side surface of the detergent supply unit 100. That is, assuming that a radial direction from the detergent storage portion 132 is a first direction W1, the inner wall 134*a*, the outer wall 134*b*, and the leakage prevention rib 154 may be provided to be overlapped with each other and thus to possibly block the first direction W1.

The leakage prevention rib 154 may include a first leakage prevention rib 154*a* formed to be inserted between the inner wall 134*a* and the outer wall 134*b*, and a second leakage prevention rib 154*b* formed along an inner side of the inner wall 134*a*.

The first leakage prevention rib 154*a* may be disposed between the inner wall 134*a* and the outer wall 134*b* so that the washing water overflowing from the detergent storage portion 132 may be guided to the leakage prevention passage 136 formed between the inner wall 134*a* and the outer wall 134*b*. A thickness of the first leakage prevention rib 154*a* may not be the same as the spaced gap between the inner wall 134*a* and the outer wall 134*b*, or may be less than the spaced gap.

The second leakage prevention rib 154*b* may be formed along the inner side of the inner wall 134*a* so that the washing water overflowing from the detergent storage portion 132 may be prevented from passing over the inner wall 134*a* and leaking to an outside. A height of the second leakage prevention rib 154*b* is not limited. However, the second leakage prevention rib 154*b* may be formed to be longer than the first leakage prevention rib 154*a*, such that the washing water does not leak from the detergent storage portion 132.

The heights of the first leakage prevention rib 154*a* and the second leakage prevention rib 154*b* are not limited, and it is sufficient as long as the first leakage prevention rib 154*a* and the second leakage prevention rib 154*b* have the heights which may be correspondingly overlapped with the inner wall 134*a* and the outer wall 134*b*.

Figure 11:
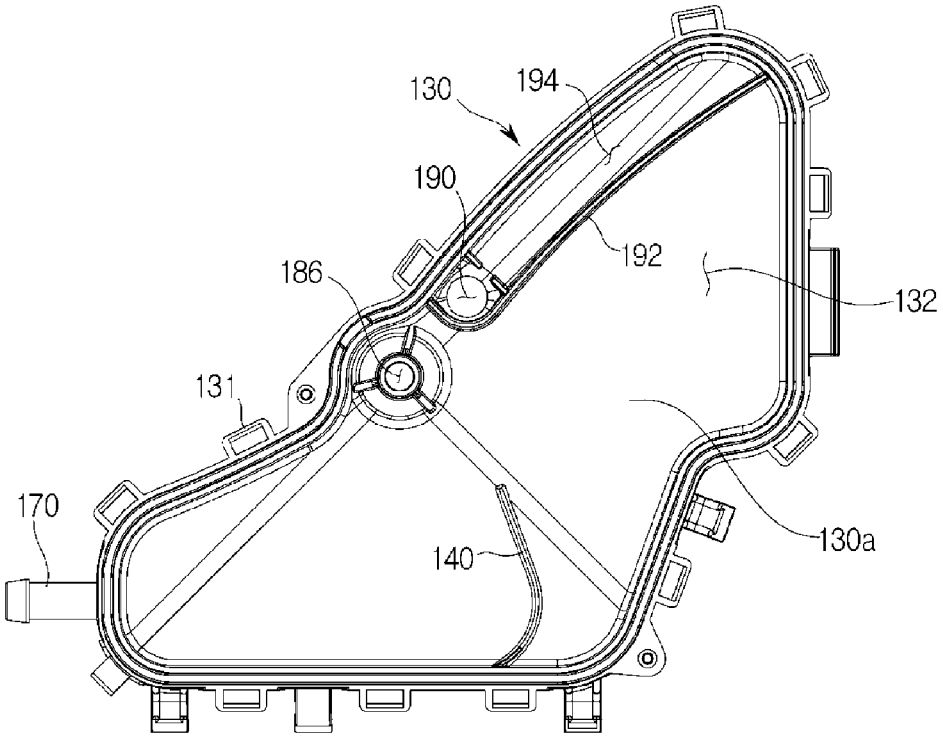
FIG. 11 is a top view of the lower case of a washing machine in accordance with one or more embodiment.

FIG. 11 is a top view of the lower case of a washing machine in accordance with one or more embodiment.

The detergent supply unit 100 may further include a washing water guide rib 140.

The water introduced through the water feed port 170 may be mixed with the detergent, thereby forming the washing water. The washing water guide rib 140 may serve to guide the washing water, such that the washing water may flow toward the washing water feed pipe 180.

Arrangement of the washing water guide rib 140 is not limited. However, in one or more embodiment, the washing water guide rib 140 may be formed to extend upward from the bottom surface 130*a* of the lower case 130, such that the washing water may collide with the inner wall 134*a* located on an extension line of the feed port 170 due to a water pressure introduced from the feed port 170 and thus may be prevented from leaking.

Further, the washing water guide rib 140 may be disposed between the feed port 170 and the inner wall 134*a* located on the extension line of the feed port 170, and may be formed in a curved line so that a flow direction of the washing water may be changed to the washing water feed pipe 180.

Hereinafter, the detergent supply unit 100 as described above will be described from a different viewpoint.

The detergent supply unit 100 may include the main body 110, a first waterproofing structure 200, and a second waterproofing structure 210.

The main body 110 may include the lower case 130 configured to form the detergent storage portion 132, and the upper case 150 disposed on the lower case 130.

The first waterproofing structure 200 is provided to prevent the leakage of the washing water from the detergent storage portion 132.

The first waterproofing structure 200 may include the plurality of lower side walls 134 and at least one upper side wall 154 which are respectively formed to extend from the lower case 130 and the upper case 150 and to be overlapped with each other.

The second waterproofing structure 210 is provided to guide the washing water leaking from the detergent storage portion 132, thereby preventing the leakage of the washing water to the outside of the detergent supply unit 100.

The second waterproofing structure 210 may include the leakage prevention passage 136 defined by one pair of lower side walls 134 of the plurality of the lower side walls 134.

The first waterproofing structure 200 is provided to prevent the leakage of the washing water from the detergent storage portion 132, and the second waterproofing structure 210 is provided to prevent the washing water leaking from the detergent storage portion 132 from leaking to the outside of the detergent supply unit 100.

As described above, since the leakage of the washing water may be doubly prevented, the detergent supply unit 100 may be effectively sealed.

Since a washing machine according to one or more embodiment may have the improved structure of the detergent supply unit and may prevent the leakage of water, it may be possible to enhance the supply efficiency of the washing water and also to prevent corrosion of the internal elements of the washing machine.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a cabinet;

a fixed tub disposed in the cabinet to store washing water;

a rotating tub rotatably disposed in the fixed tub; and a detergent supply unit configured to receive water to be mixed with a detergent to form the washing water and to supply the washing water into the rotating tub, wherein the detergent supply unit comprises:

a main body configured to form an exterior;

a detergent storage portion provided in the main body; and a leakage prevention passage provided to enclose at least part of the detergent storage portion and configured to guide the washing water overflowing from the detergent storage portion into the rotating tub, wherein the main body includes a lower case configured to have a bottom surface, an inner wall, and an outer wall, the inner wall and the outer wall extending upward from the bottom surface and forming a gap between the inner wall and the outer wall, wherein the leakage prevention passage is provided in the gap to prevent leakage of washing water that leaks from the detergent storage portion to an outside of the detergent supply unit; and an upper case coupled to an upper portion of the lower case to form the detergent storage portion, and configured to have a leakage prevention rib formed to extend downward from the upper case such that the inner wall of the lower case and the leakage prevention rib overlap each other thereby forming a labyrinth structure with respect to the inner wall and the outer wall to cover the gap and to prevent leakage of the washing water from the detergent storage portion into the leakage prevention passage.

2. The washing machine according to claim 1, wherein the detergent supply unit further comprises a leaking water outlet port provided at the leakage prevention passage so that the washing water guided through the leakage prevention passage is discharged into the rotating tub.

3. The washing machine according to claim 2, wherein the leakage prevention passage has a first portion and a second portion, the first portion is formed to be higher than the second portion, and the second portion is disposed to be closer to the leaking water outlet port than the first portion.

4. The washing machine according to claim 1, wherein the leakage prevention passage encloses an entire area along a circumference of the main body.

5. The washing machine according to claim 1, wherein the inner wall partitions the detergent storage portion and the leakage prevention passage from each other and is provided to enclose the detergent storage portion; and the outer wall is provided to enclose the inner wall and thereby form the gap.

6. The washing machine according to claim 5, wherein the detergent supply unit further comprises a detergent introduction case provided above the upper case and configured to have an inlet flange to pour the detergent into the detergent storage portion.

7. The washing machine according to claim 5, wherein the leakage prevention rib comprises:

a first leakage prevention rib to extend downward between the inner wall and the outer wall; and a second leakage prevention rib to extend downward and formed along an inner side of the inner wall.

8. The washing machine according to claim 1, wherein the detergent supply unit comprises:

a water feed port in communication with the detergent storage portion to receive the water from an outside; and a washing water feed pipe configured so that the washing water formed in the detergent storage portion is supplied into the rotating tub.

9. The washing machine according to claim 8, wherein the washing water feed pipe is formed so that the washing water is supplied into the rotating tub by a siphon phenomenon.

10. The washing machine according to claim 8, wherein the detergent supply unit further comprises a washing water guide rib provided above the detergent storage portion to guide the washing water from the water feed port to the washing water feed pipe.

11. The washing machine according to claim 10, wherein the washing water guide rib is formed in a direction which blocks a flow direction of the washing water from the water feed port.

12. The washing machine according to claim 10, wherein the washing water guide rib is provided at the lower case.

13. A detergent supply unit for a washing machine configured to receive water to be mixed with detergent to form washing water, comprising:

a main body configured to form an exterior;

a detergent storage portion provided in the main body; and a leakage prevention passage provided to enclose at least part of the detergent storage portion and configured to guide the washing water overflowing from the detergent storage portion into a rotating tub of the washing machine wherein the main body includes a lower case configured to have a bottom surface, an inner wall, and an outer wall, the inner wall and the outer wall extending upward from the bottom surface and forming a gap between the inner wall and the outer wall, wherein the leakage prevention passage is provided in the gap to prevent leakage of washing water that leaks from the detergent storage portion to an outside of the detergent supply unit; and an upper case coupled to an upper portion of the lower case to form the detergent storage portion, and configured to have a leakage prevention rib formed to extend downward from the upper case such that the inner wall of the lower case and the leakage prevention rib overlap each other thereby forming a labyrinth structure with respect to the inner wall and the outer wall to cover the gap and to prevent leakage of the washing water from the detergent storage portion into the leakage prevention passage.

14. The detergent supply unit according to claim 13, wherein the detergent supply unit further comprises a leaking water outlet port provided at the leakage prevention passage so that the washing water guided through the leakage prevention passage is discharged into the rotating tub.

15. The washing machine according to claim 13, wherein the inner wall partitions the detergent storage portion and the leakage prevention passage from each other and is provided to enclose the detergent storage portion; and the outer wall is provided to enclose the inner wall and thereby form the gap.

16. The washing machine according to claim 13, wherein the leakage prevention rib comprises:

a first leakage prevention rib to extend downward between the inner wall and the outer wall; and a second leakage prevention rib to extend downward and formed along an inner side of the inner wall.

* * * * *